US005405295A

United States Patent [19]

Lord

[11] Patent Number: 5,405,295

[45] Date of Patent: Apr. 11, 1995

[54] BOWLING ALLEY BUMPER SYSTEM

[75] Inventor: C. Dennis Lord, Red Oak, Tex.

[73] Assignee: AMF Bowling, Inc., Mechanicsville, Va.

[21] Appl. No.: 920,520

[22] Filed: Jul. 28, 1992

Related U.S. Application Data

[63] Continuation of Ser. No. 758,003, Sep. 12, 1991, abandoned.

[51] Int. Cl.[6] ..... A63D 5/00

[52] U.S. Cl. ..... 473/55; 473/113

[58] Field of Search ..... 473/54, 55, 56, 106, 473/113

[56] References Cited

U.S. PATENT DOCUMENTS

| | | | |
|---|---|---|---|
| 2,949,303 | 8/1960 | Sherman | 273/51 |
| 3,063,717 | 11/1962 | Lemieux | 273/47 |
| 3,304,087 | 2/1967 | Untiedt | 273/47 |
| 3,761,086 | 9/1973 | Miller | 273/47 |
| 4,801,143 | 1/1989 | Heddon | 273/47 |
| 4,900,024 | 2/1990 | Chandler et al. | 273/37 |
| 4,913,433 | 4/1990 | Rochefort | 273/51 |

*Primary Examiner*—Vincent Millin
*Assistant Examiner*—William M. Pierce
*Attorney, Agent, or Firm*—Bacon & Thomas

[57] ABSTRACT

Bumper bowling systems include retractable bumpers and mechanisms connected to the retractable bumpers disposed alongside a bowling alley's gutters. The mechanisms are adapted to extend the bumpers into a position which prevent bowling balls from falling into the gutter and also to retract the bumpers to permit ordinary bowling. A segmented longitudinally extending cap and a structural support member are also provided so that the cap covers the bumper mechanism.

1 Claim, 4 Drawing Sheets

BOWLING ALLEY BUMPER SYSTEM

This application is a Continuation of application Ser. No. 07/758,003, filed Sep. 12, 1991, now abandoned.

FIELD OF THE INVENTION

This invention relates to bowling alley bumper systems and the mechanisms which include elongated retractable bumpers disposed alongside a bowling alley's gutters and, more particularly, to such systems which include a cap or cover disposed above the mechanism.

BACKGROUND OF THE INVENTION

Bowling alley bumper systems have been available since at least as early as 1965. Such systems were designed to be used by children and/or the physically handicapped as well as others who lack the physical coordination or strength to bowl, i.e., project a majority of the balls over the length of the alley without ending up in one of the gutters. Early systems required relatively difficult steps to set up a lane or lanes for so called "bumper" bowling. For this reason, a number of bowling alley operating personnel were reluctant to promote "bumper" bowling or to encourage children or the handicapped to use their lanes.

More recently, a bowling alley bumper mechanism such as the one disclosed in the United States patent of Chandler et al., U.S. Pat. No. 4,900,024, overcame many of the earlier problems. In such systems, an elongated bumper is mounted alongside and parallel to each alley gutter. The systems also include movable supports that permit the extension of the bumpers to guard the gutters when guarding is desired and retraction of the bumpers to expose the gutters when normal alley operation is desired.

It is now believed that the availability of the Chandler-type systems, coupled with a change in demographics and business pressures will encourage bowling alley operators to put more emphasis on bumper bowling to encourage children to learn to bowl, attract families and to provide a challenging game for the physically handicapped. For this reason, it is believed that there is a demand for an improved bowling alley bumper system which provides a more attractive appearance, is relatively inexpensive to manufacture, easy to install and remove, protects the mechanism from damage and, at the same time, provides more ready access to the rear of the lanes without walking on the lanes. In view of the fact that many such systems will be installed over a ball return, it is also desirable to have easy access to the ball return in the area of the ball pick-up mechanisms.

It has now been found that an improved bowling alley bumper system, in accordance with the present invention, provides the aforementioned desirable features.

BRIEF SUMMARY OF THE INVENTION

The bowling alley bumper system, according to the present invention, includes retractably-mounted bumpers that are deployed alongside conventional bowling alley gutters. During ordinary bowling, the bumpers are retracted and positioned alongside the outer peripheries of the gutters to fully expose the gutters as in conventional bowling alleys. However, when it is desired to provide bumpering, the bumpers are extended into position so that they lie parallel to the gutters and nearer the alley surfaces to ward off bowling balls that would otherwise fall into the gutters. The bowling alley bumper system, according to the present invention, is also characterized by cap means and means for supporting the cap means above the bumper system. In accordance with a preferred embodiment of the invention, the cap means defines a longitudinally extending shoulder which is parallel to the gutters and which extends outwardly beyond the support means and over the bumper mechanism when the bumper mechanism is in a retracted position.

DETAILED DESCRIPTION OF THE PREFERRED EMBODIMENTS OF THE INVENTION

Figure 1:
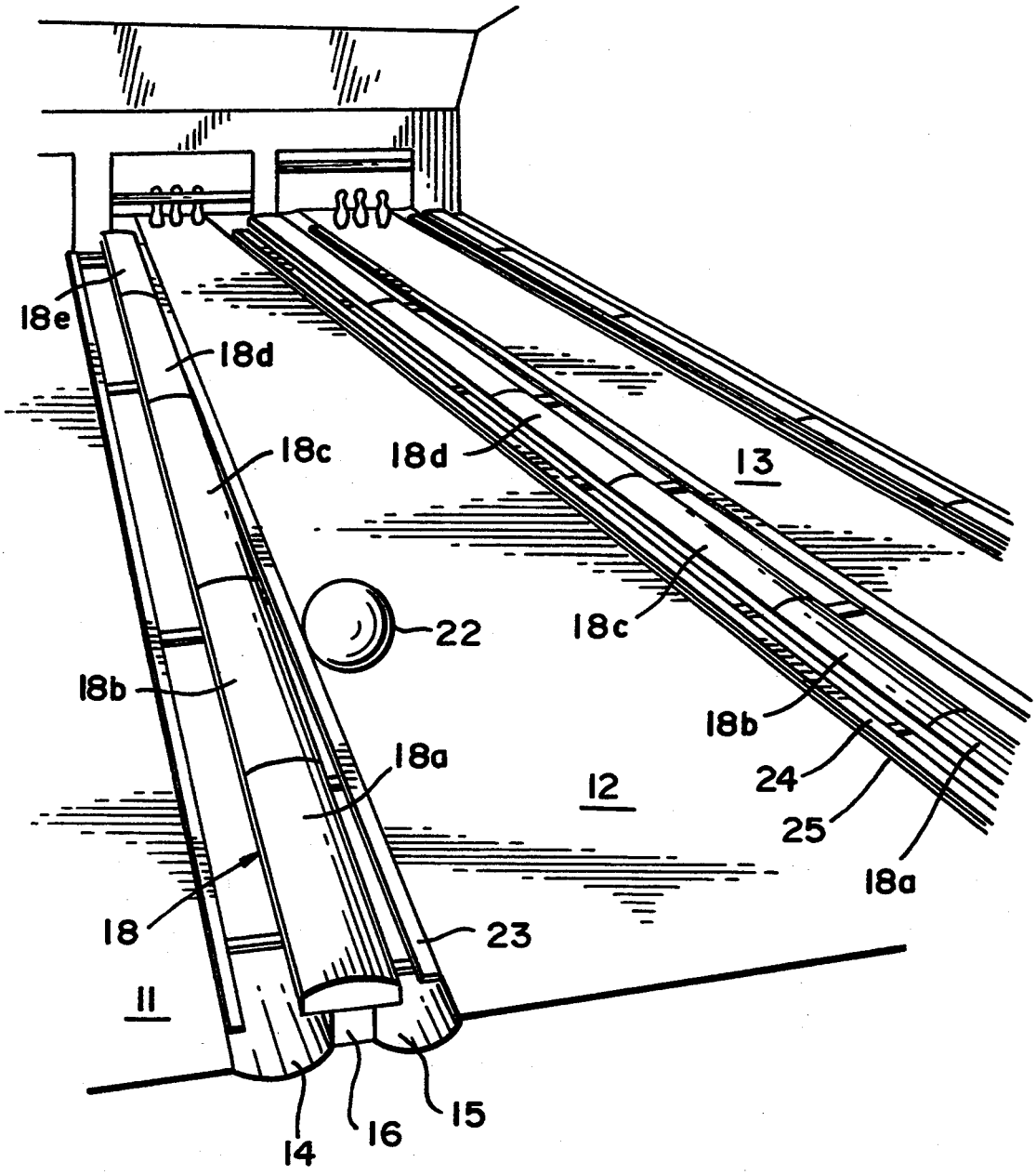
FIG. 1 is a perspective view which illustrates one embodiment of the invention.

The invention will now be described in more detail in connection with the accompanying drawings wherein like reference numerals have been used to identify like parts.

As illustrated in FIG. 1, a bowling alley establishment includes a plurality of side by side alleys 11, 12 and 13. As illustrated, alley 13 is an end alley, i.e., one which has a single alley 12 next to it while 12 has one more on each side, i.e., alleys 11 and 13.

In bowling, each alley includes a pair of gutters 14 and 15, one on each side thereof, which extends along the length of the alley to receive and direct bowling balls which fall therein to a pit assembly at the far end of the alley. In a typical bowling alley establishment, adjacent gutters, such as gutters 14 and 15, are separated by a space 16 which may cover a below-floor ball return (not shown). This space 16 is typically covered with a cap such as a wooden plank (not shown), the installation of which will be readily understood by those skilled in the art. It is also common practice to deploy an under floor ball return under the cap.

A retractable bumpering mechanism for use in connection with the present invention is disclosed in the United States Patent of Chandler et al., U.S. Pat. No. 4,900,024, which is incorporated herein in its entirety by reference. As disclosed therein and as shown in FIG. 1, a bumpering member 23 which is shown in its extended position, extends over gutter 15 to deflect a bowling ball 22 back onto alley 12. Thus, the bumpering member 23 prevents ball 12 from falling into gutter 15 even through it was bowled in that direction. A second bumpering member 24 is also shown in its extended position on the opposite side of alley 12 to prevent a ball from falling into gutter 25. Therefore, when a pair of bumpering members are extended outwardly over a pair of gutters, a bowling ball will be deflected by one or the other bumpering members and thus direct the ball to the pin deck, i.e., the area in which the pins are standing.

Figure 2:
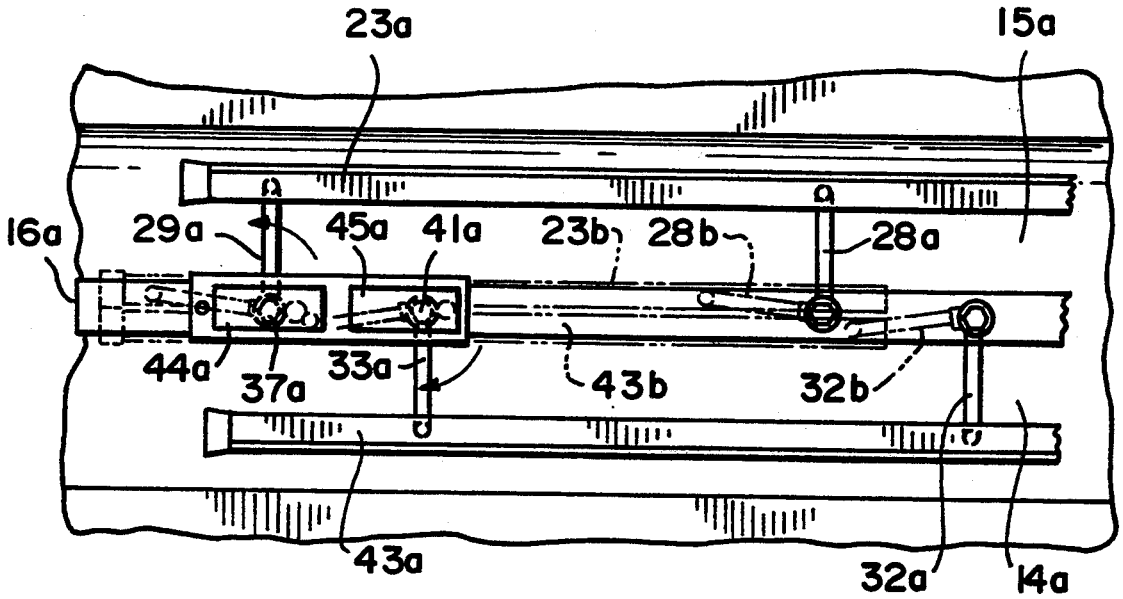
FIG. 2 is a plan view which illustrates a prior art bumper system.

As illustrated in FIG. 2, the bumper mechanism of Chandler et al. includes a pair of bumpers mounted in partially-nesting relationship on a relatively narrow guide member which separates two adjacent alleys. This median corresponds to median guide member 16 of FIG. 1 and is identified in FIG. 2 as 16*a*.

Deployment of the bumpers between their active and inactive positions is accomplished by a manual swivelling movement of the bumpers or by means of conventional motor/gearbox assemblies 44*a* and 45*a*. Also shown in FIG. 2 are gutters 14*a* and 15*a*, bumpers 23*a* and 43*a*, support arms 28*a*, 29*a*, 32*a* and 33*a* and swivels 37*a* and 41*a*.

The bumpering members 23*a* and 43*a* are shown in their extended or actuated positions where they are positioned at a sufficient distance from guide member 16*a* to prevent bowling balls from entering gutters 14*a* or 15*a*. FIG. 2 also illustrates the retracted or inactive position of the bumpers by dashed lines which are identified by symbols that include the letter "b." Thus, the retracted position of bumper 23*a* is shown by the dashed lines 23*b* and the retracted position of bumper 43*a* is shown by dashed lines 43*b*.

Figure 3:
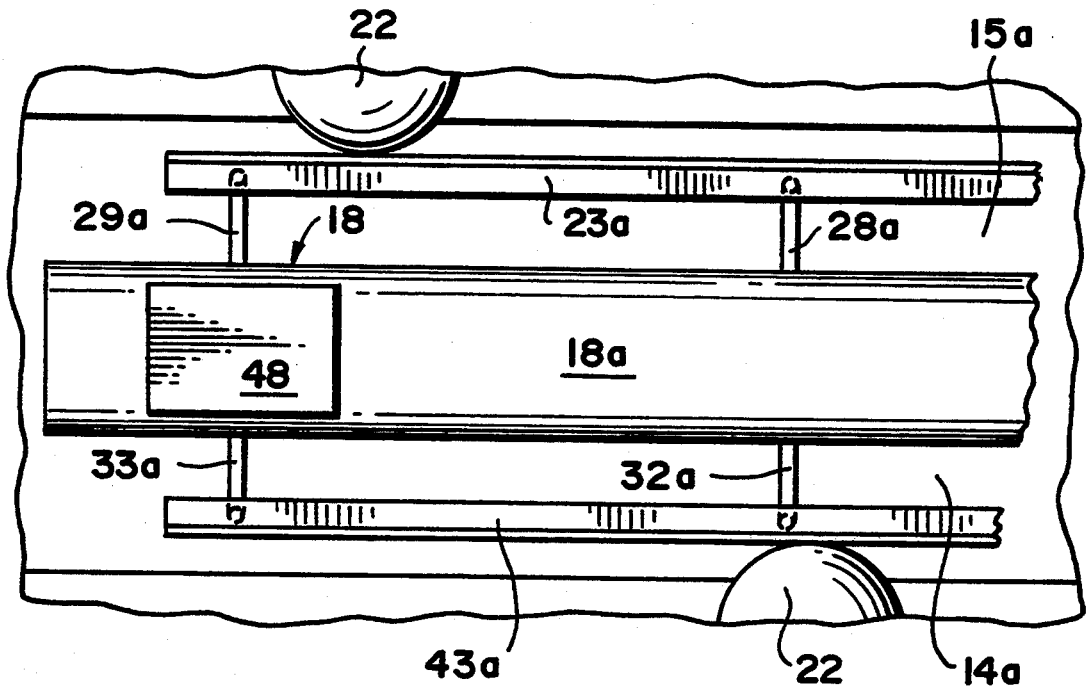
FIG. 3 is a plan view which illustrates one embodiment of the invention with the bumpers in an extended position.
Figure 4:
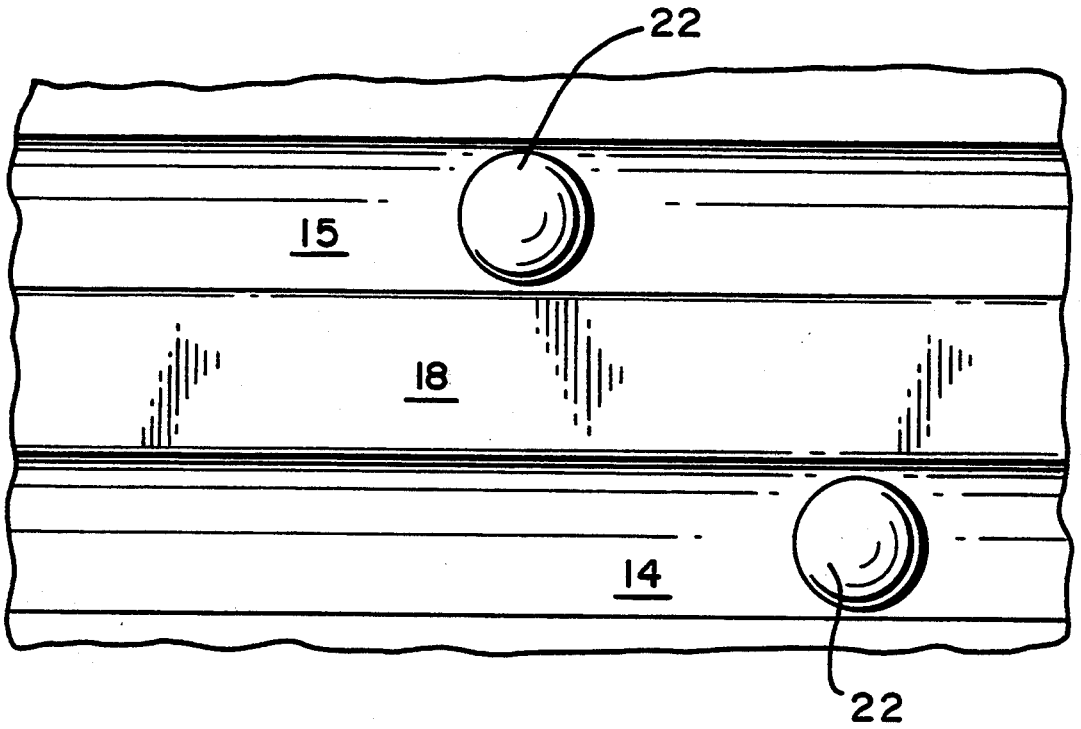
FIG. 4 is a plan view which illustrates the bumper system of FIG. 3 but with the bumpers in a retracted position.
Figure 5:
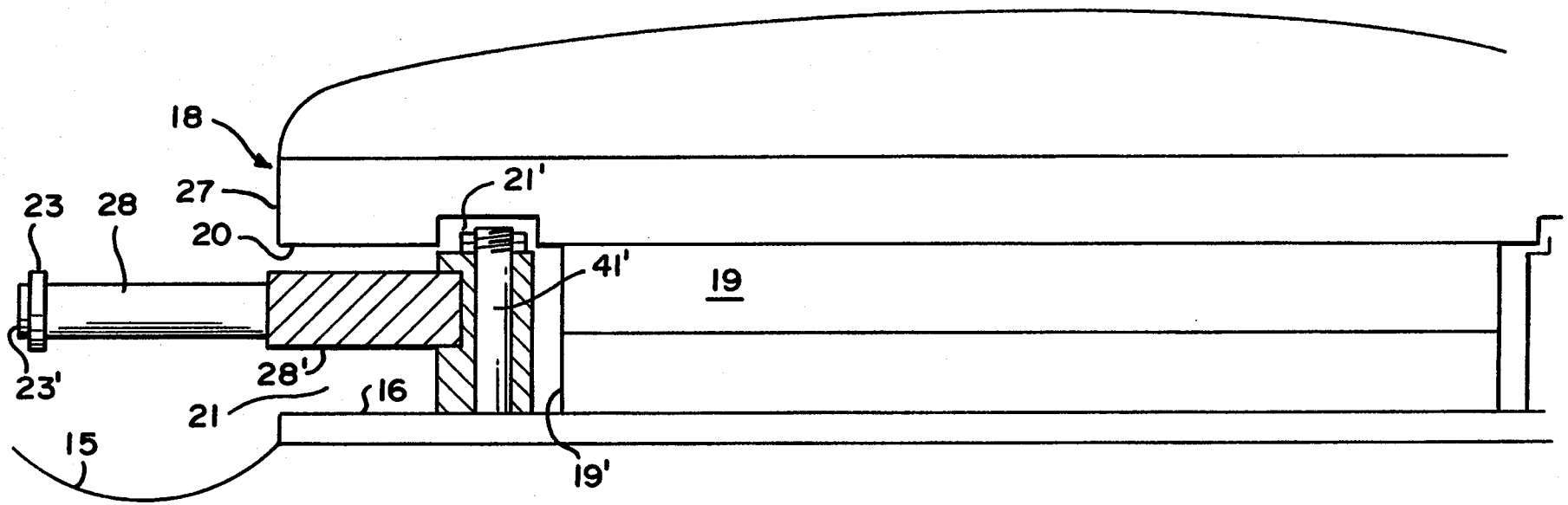
FIG. 5 is an end view which illustrates a preferred form of cap means in accordance with the present invention.

An improved bowling alley bumper system is illustrated more clearly in FIGS. 3 through 5. As shown therein, a segmented longitudinally extending cap means or member 18 includes a plurality of segments 18*a* through 18*e* as shown more clearly in FIG. 1. The cap member 18 is disposed above and over the bowling alley bumper system and extends over the length of the alley so that the entire system is covered by cap member 18 as shown in FIG. 4 when the bumpers 23*a* and 43*a* are in their retracted positions as shown by 23*b* and 43*b* on FIG. 2. As illustrated in FIG. 4, the bowling alley presents a conventional appearance and balls 22 are shown in gutters 14 and 15.

The cap member 18 and each of its segments 18*a* through 18*e* are supported by means such as a longitudinally extending supporting member 19 which may be made up of one or more planks of wood. Supporting member 19 is also formed of a plurality of segments (not shown) which correspond to segments 18 and in accordance with the preferred embodiment of the invention. As shown in FIG. 5, the cap member 18, including each of its segments may also comprise a pair of longitudinally extending wooden planks with the top surface of the upper plank being contoured to provide a slightly curved surface, rounded off at the outer edge thereof, to provide a pleasing appearance.

The cap member 18 also defines a shoulder 20 and inwardly extending channel 21 which is defined by shoulder 20, supporting member 19 and a portion of space 16. The shoulder 20 also includes means which define a second channel or groove 21' which is disposed between an outer edge 27 of cap member 18 and an outer edge 19' of supporting member 19.

The second channel or groove 21' is disposed immediately above the bumper mechanism. For example, bumper 23 is disposed at the end of a rod like element 28 and may include a rubber bumper means 23' attached thereto. The rod 28 may be supported within a housing 28' and may including a spring assembly (not shown) as disclosed in more detail in the aforementioned Chandler et al. patent. The support housing 28' is carried by a swivelable assembly 41 which swivels about a vertical post 41'. Post 41' extends upwardly into channel or groove 21'.

As shown in FIG. 3, segment 18*a* includes an access door 48 which is disposed above a portion of the ball return (not shown) in the area of the ball pick-up mechanism. The access door 48 provides access to the ball return without removing segment 18*a* when a ball is not picked up by the ball pick-up mechanism.

The cap means 18 and support member 19 are constructed and arranged so that an individual can walk on cap means 18 without adversely affecting the bumper mechanism. In this manner, an individual can walk to the far. end of an alley without stepping on the alley or tripping on the bumper mechanism which may be necessary to remove any fallen pins which are forward of the pin deck.

While the invention has been described in connection with one of its preferred embodiments, it should be understood that changes and modifications may be made without departing from the scope of the appended claims.

What is claimed is:

1. In a bowling alley bumper system for guarding the gutter of a bowling alley of the type having a mechanism including a longitudinal guide adjacent to and positioned alongside said gutters, said gutters having a major axis and said longitudinal guide mounted on the opposite side of said gutter from said alley, said bumper mechanism comprising: guarding means including a first elongated bumper separated from and disposed alongside said gutter and having a major axis parallel to the major axis of said gutter, and extending and retracting means for mounting, extending and retracting said bumper, said extending and retracting means being interconnected between said bumper and said longitudinal guide; said extending and retracting means being effective when in its extended condition to position said guarding means for deflecting bowling bails that may be directed toward said gutter, and said extending and retracting means being effective when in its retracted condition to position said guarding means for exposing said gutter and permitting bails directed toward said gutter to fail thereinto; said system also including a second alley adjacent to said first alley and wherein said longitudinal guide is disposed parallel to and between said gutter of said first alley and a gutter of said second alley, and wherein there is included a second elongated bumper disposed alongside said gutters of said second alley, and wherein said bumper system further comprises: second guarding means including said second elongated bumper separated from and disposed alongside said gutter of said second alley and having a major axis parallel to the major axis of said gutter of said second alley, and second extending and retracting means for mounting, extending and retracting said second bumper, said second extending and retracting means being interconnected between said second bumper and said longitudinal guide, said second extending and retracting means being effective when in its extended condition to position said second guarding means for deflecting bowling balls that may be directed toward said second gutter, said second extending and retracting means being effective when in its retracted condition to position said second guarding means for exposing said second gutter and permit balls directed toward said second gutter to fall thereinto, the improvement comprising a segmented longitudinally extending cap means including a plurality of longitudinally extending segments which are disposed between adjacent alleys and separated therefrom by one of said gutters of each of said alleys and in which said longitudinally extending segments together extend along the length of said alley for covering said bowling alley bumper system including said first and second elongated bumpers when in the retracted position, segmented longitudinally extending structural support means which correspond to the segments of said cap means disposed below said cap means and supporting said cap means above said bumper system with sufficient structural integrity to permit a bowler to walk on said cap means without interfering with or damaging the bumper mechanism, said cap means further defining a longitudinally extending shoulder which extends outwardly beyond said support means and over said bowling alley bumper mechanism when said bumper mechanism is in a retracted position and access means within said cap means so that an individual can gain access to an area below said bowling alley bumper system without removing said cap means and said improvement further comprising said shoulder defining upper and lower surfaces and a longitudinal channel defined by said lower surface so that a portion of said bumper mechanism extends upwardly and into said channel.

* * * * *